United States Patent [19]

Brenner et al.

[11] 4,420,952

[45] Dec. 20, 1983

[54] LIQUID PUMPING AGITATOR WITH BARREL VALVE FOR AUTOMATIC WASHERS

[75] Inventors: Robert A. Brenner; Jack F. Clearman; Clark I. Platt, all of St. Joseph Township, Berrien County, Mich.

[73] Assignee: Whirlpool Corporation, Benton Harbor, Mich.

[21] Appl. No.: 294,138

[22] Filed: Sep. 19, 1981

[51] Int. Cl.[3] ..... D06F 17/10

[52] U.S. Cl. ..... 68/53; 68/134

[58] Field of Search ..... 68/53, 131, 132, 133, 68/134, 184, 23.7, 18 FA

[56] References Cited

U.S. PATENT DOCUMENTS

| | | | |
|---|---|---|---|
| 2,909,051 | 10/1959 | Altorfer . | |
| 3,022,655 | 2/1962 | Gerhardt et al. . | |
| 3,091,954 | 6/1963 | Bullock et al. . | |
| 3,132,500 | 5/1964 | Bullock | 68/134 X |
| 3,145,553 | 8/1964 | McMillan . | |
| 3,314,253 | 4/1967 | Smith | 68/53 X |
| 4,134,277 | 1/1979 | Platt et al. | 68/53 |

FOREIGN PATENT DOCUMENTS

| | | | |
|---|---|---|---|
| 529983 | 7/1954 | Belgium | 68/53 |

*Primary Examiner*—James E. Bryant, III
*Assistant Examiner*—Joseph M. Pitko
*Attorney, Agent, or Firm*—Hill, Van Santen, Steadman & Simpson

[57] ABSTRACT

A fluid pumping agitator fur use in a vertical axis automatic clothes washing machine which pumps wash liquid from an inlet in the skirt portion of the agitator to an outlet in the barrel portion of the agitator. The agitator pumps liquid in one rotational direction of its oscillatory rotational movement. The barrel portion has a chamber in which can be placed wash liquid treatment means such as a filter.

17 Claims, 7 Drawing Figures

LIQUID PUMPING AGITATOR WITH BARREL VALVE FOR AUTOMATIC WASHERS

BACKGROUND OF THE INVENTION

1. Field of the Invention

This invention relates to a washing machine having a liquid pumping agitator, and more particularly to a washing machine wherein wash liquid is pumped upwardly through the interior of the agitator during the wash cycle.

2. Description of the Prior Art

Various attempts have been made at pumping wash liquid upwardly through the agitator of an automatic washing machine during the washing cycle. U.S. Pat. No. 2,909,051 discloses a wash liquid pumping agitator in which the agitator travels through the orbital path as opposed to rotating about a center axis and within the interior of the agitator there is provided a positive displacement pump which has an expanding and contracting chamber integrally connected with a cam arrangement to force the wash liquid upwardly through the agitator. Check valves are provided to maintain the flow of wash liquid up through the agitator in one direction.

U.S. Pat. No. 3,022,655 discloses a valveless pumping agitator which utilizes four spiral portions to ram wash liquid through inlet openings 26 upwardly through the spiral passage to the barrel of the agitator when the agitator moves in the clockwise portion of an oscillatory movement.

U.S. Pat. No. 3,091,954 discloses a positive displacement piston pump utilizing a fixed check valve and a floating check valve to pump wash liquid upwardly through the agitator as the agitator moves up and down in a reciprocating motion.

U.S. Pat. No. 3,145,553 discloses a vaned positive displacement pump which utilizes two sets of check valves to provide the wash liquid flow upwardly through the agitator to an agitator mounted filter.

SUMMARY OF THE INVENTION

In accordance with the present invention a wash liquid pumping agitator for an automatic washer is provided wherein the inertia of the wash liquid in the washer basket relative to the oscillatory movement of the agitator is used to force the wash liquid to follow a path through an arcuate channel in the skirt of the agitator and up the interior of the barrel to discharge from the top of the agitator. The arcuate channel in the agitator may comprise a spiral channel around the skirt of the agitator having an inlet in the top wall of the agitator skirt and an outlet which communicates a vertical channel extending up the interior of the agitator barrel.

The arcuate channel, has a length which is approximately equal to or greater than the circumference of the agitator skirt which provides a large volume of water which, during the reverse stroke of the agitator, gains inertia such that during the pumping stroke there is sufficient inertia in the volume of water to provide an adequate pumping head to the top of the agitator. A disc valve means is provided in the vertical channel in the barrel to prevent the wash liquid from flowing in a reverse direction down the vertical channel in the barrel during the reverse stroke.

Thus, as the agitator rotates in a first or pumping direction, the relative movement between the agitator and the wash liquid within the spiral channels is such so as to cause the wash liquid to be forced upwardly through the vertical channel and past the disc valve means and to exit through openings in the top of the barrel to return to the basket. As the agitator rotates in the reverse direction, the disc valve means prevents the wash liquid from flowing downwardly through the agitator barrel and allows the wash liquid to gain reverse inertia which is utilized in the clockwise rotation of the agitator to pump the water upwardly.

A first embodiment is a continuous spiral which pumps during the counterclockwise rotational movement. A second embodiment is a serpentine arcuate channel which pumps during the counterclockwise rotational movement. The serpentine channel has an outer channel portion approximately equal to the circumference of the skirt.

The disc valve means is freely mounted which helps to prevent the collection of lint on the valve, and the disc is easily removed for cleaning. The long spiral channel and free moving disc valve are important features when the agitator is utilized in a machine having a relatively short stroke and high oscillation rate such as 100° stroke and an oscillation rate of 180 strokes per minute.

The wash liquid which has been forced up the vertical channel in the barrel can be used for various functions such as filtering and/or dispensing of wash additives.

DESCRIPTION OF THE PREFERRED EMBODIMENTS

Figure 1:
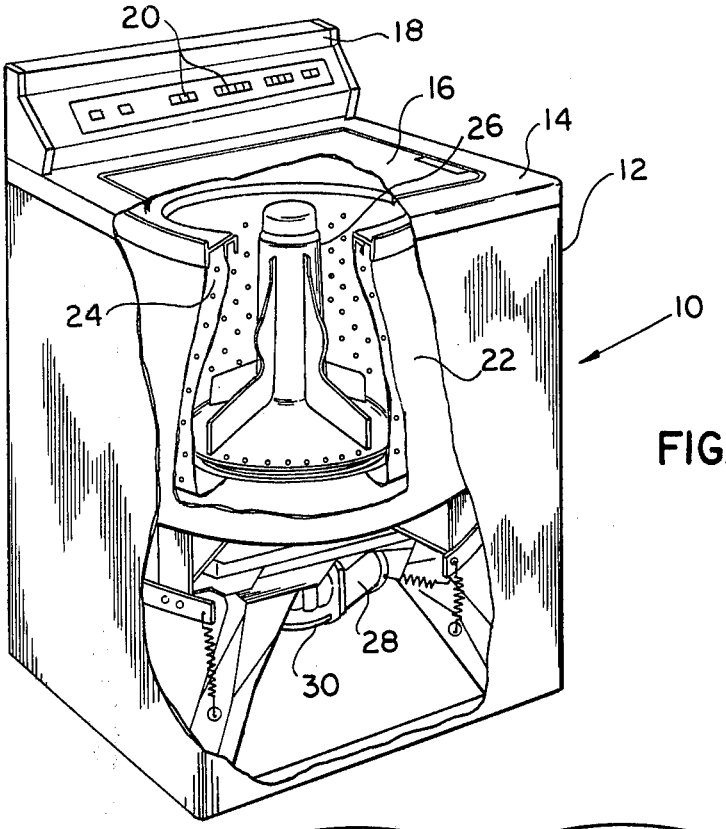
FIG. 1 is a perspective view of a washing machine embodying the present invention, partially cut away to show the interior mechanism thereof.

A laundry appliance 10 comprising an automatic clothes washer embodying the principles of the present invention is depicted in FIG. 1. The washer is comprised of a cabinet 12 having a top 14 with a lid 16 and a console 18 having presettable controls 20 thereon of the type wherein an operator may pre-select a program of automatic washing, rinsing and centrifuging steps in a laundering process. The lid 16 in the top 14 of the cabinet 12 may be opened to permit access into the top of a tub 22 housed within the cabinet 12. Enclosed by and supported within the tub 22 is a clothes container or a spin basket 24 within which is oscillatably mounted an agitator 26.

Below the tub 22 but within the cabinet 12 there is provided an electric motor 28 which oscillatably drives the agitator 26 through a transmission 30. The agitator 26 is shown in greater detail in FIGS. 2 and 3 where it is seen that the agitator 26 is comprised of a skirt portion 32 near the bottom of the agitator and a substantially vertical barrel portion 34 integrally connected with the skirt and projecting upwardly therefrom. A plurality of vanes 36 are provided around the periphery of the barrel 34 and extend downwardly and outwardly along the skirt portion 32 of the agitator 26. At the top of the barrel 34 there is provided a removable cap 38 which is frictionally retained thereon.

Figure 3:
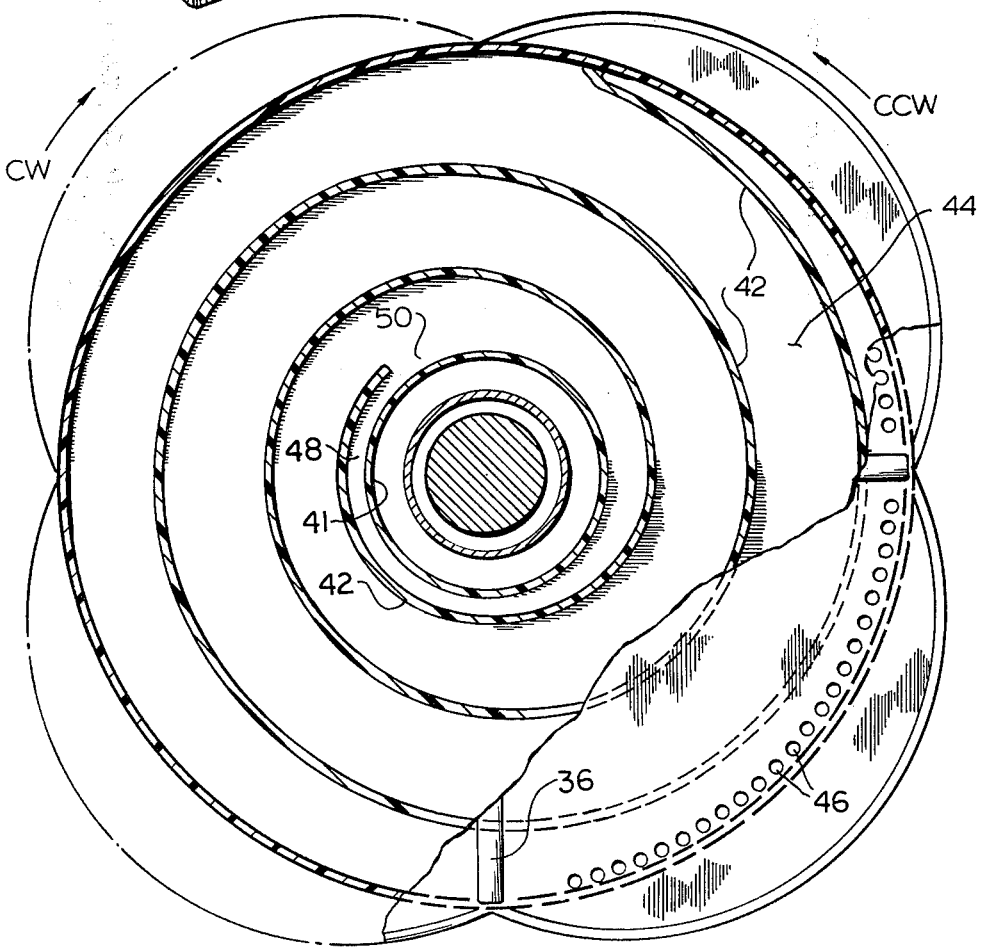
FIG. 3 is a sectional view of the agitator taken generally along the lines III—III of FIG. 2.

The agitator 26 is of a two-wall construction having an outer wall 40 and a radially inwardly spaced inner wall 41. In the skirt portion 32 of the agitator 26 there is provided an upstanding rib 42 which extends between the inner wall 41 and outer wall 40 and is disposed in a spiral manner in the skirt portion 32 as is best seen in FIG. 3.

The spirally disposed rib 42 thus defines an arcuate or spiral channel 44 within the skirt portion 32 of the agitator 26. A plurality of inlet apertures or openings 46 are provided through a top wall 47 of the skirt 32 around a portion of the periphery of the skirt to allow wash liquid to enter the spiral channel 44.

The barrel portion 34 defines an annular space or channel 48 between the inner wall 41 and the outer wall 40. The annular barrel channel 48 communicates with the spiral skirt channel 44 at the base of the barrel portion shown generally at 50.

The top of the inner wall 41 terminates below the top of the outer wall 40 in a top wall 52 which has a central aperture 54 therethrough. A splined portion of a drive shaft 56 mates with a cylindrical splined portion **52*a* of top 52 and is used to drive the agitator 26 in an oscillatory motion. The agitator 26 is secured to shaft 56 by means of appropriate fastening means 58 such as a bolt screwed into the splined end of the shaft 56. The outer wall 40 continues upwardly beyond the top wall 52 of the inner wall 41 and terminates at a top end 60 to which the cap 38** is secured.

Figure 2:
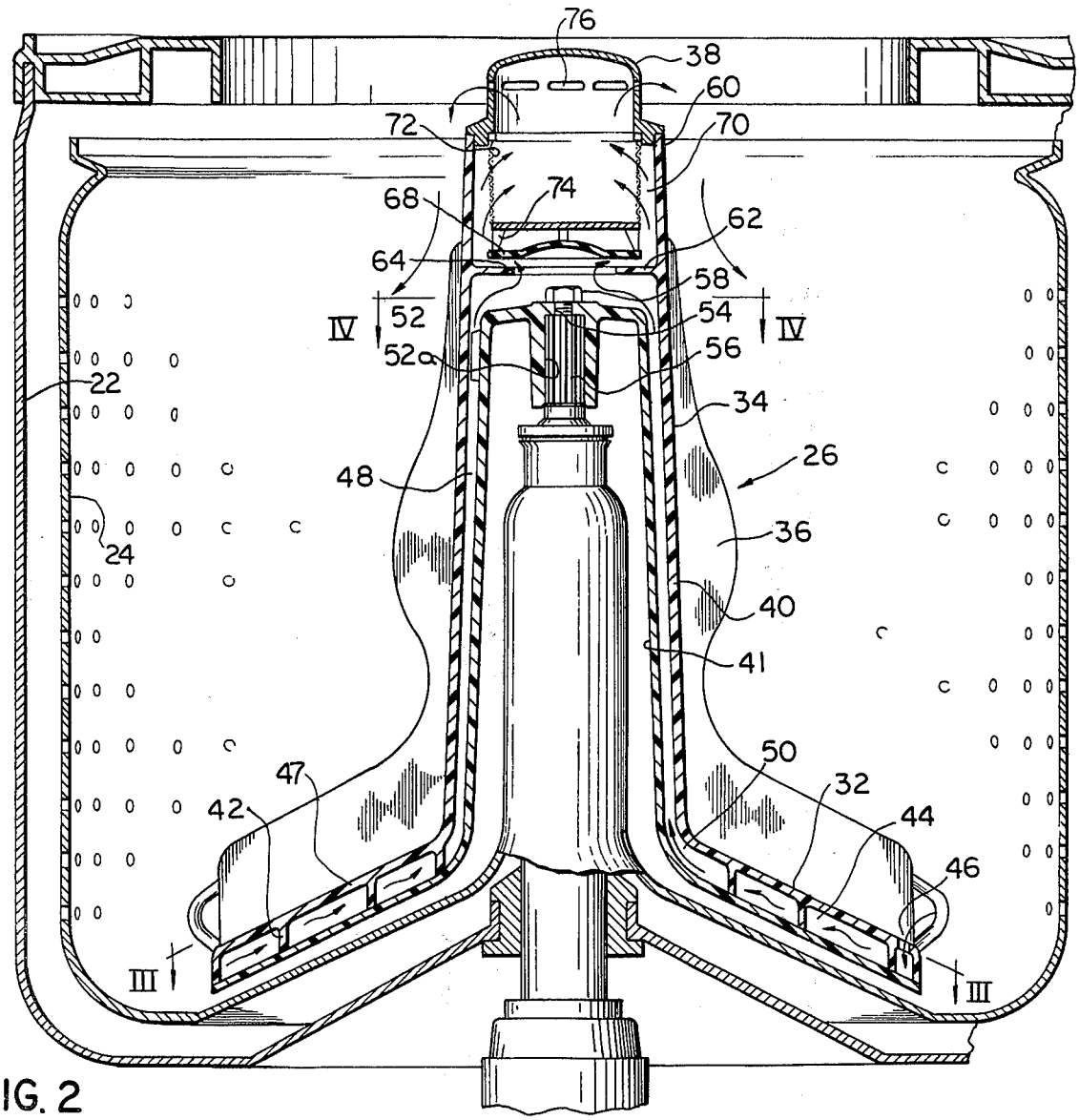
FIG. 2 is a side sectional view of the agitator assembly within the tub and basket of the washing machine.
Figure 4:
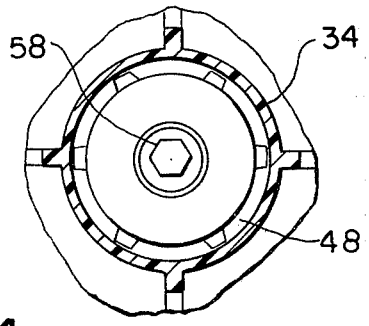
FIG. 4 is a sectional view of the barrel of the agitator taken generally along the lines IV—IV of FIG. 2.
Figure 5:
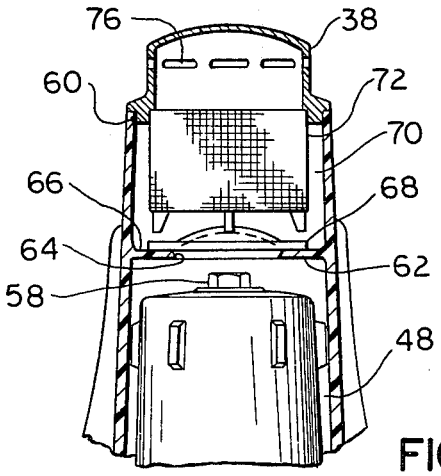
FIG. 5 is a partial sectional view of the upper portion of the barrel shown in FIG. 2.

Above the top wall 52 of the inner wall 41 and below the top end 60 of the outer wall 40, there is provided a radially inwardly extending annular wall 62, best seen in FIGS. 2 and 5, which defines a large central circular opening 64 therethrough. As shown in FIG. 5, a top surface 66 of the annular wall 62 acts as a lip and provides vertical support for a disc valve means 68 which is used to selectively close the opening 64 through the annular wall 62.

Above the annular wall 62 and below the top end 60 of the outer wall 40 there is provided a chamber 70. Within this chamber 70 can be provided a wash liquid treatment means 72 such as a filtering means which is removably secured within the chamber 70 by the cap 38. The filtering means 72 has a plurality of downwardly extending legs 74 which restrain the disc valve means 68 from excessive vertical movement. The cap 38 has a plurality of outlet openings 76 therethrough which provide communication between the chamber 70 and the interior of the basket 24 of the washer. Thus, as seen in FIG. 2, there is provided a fluid path from the interior of the basket 24 through the inlet openings 46 in the skirt portion and through the spiral channel 44, through the opening at 50, into the vertical annular channel 48, and up through central opening 64 into the cavity 70 through the filtering means 72 and through outlet openings 76.

Periodically throughout the steps of the washing operation, the agitator is rotated in an oscillatory manner such that part of its rotation is in a clockwise direction as shown in FIG. 3 by arrow CW and another part of its rotation is in a counterclockwise direction as shown by arrow CCW. During this movement, there is a supply of wash liquid within the basket 24 which is generally above the level of the skirt portion 32 of the agitator 26 such that the wash liquid enters the inlet openings 46 and completely fills the spiral channel 44. As the agitator 26 oscillates, the agitator acts as a pump in the following manner.

As the agitator rotates in the counterclockwise direction as shown by arrow CCW, the inertia of the wash liquid within the channel 44 tends to hold the liquid stationary and thus result in a relative rotational movement between the liquid and the agitator 26. In this manner the liquid in the channel is forced spirally inwardly toward the opening 50 and upwardly through the vertical channel 48 lifting the free floating disc valve means 68 to a position against the legs 74 of the filtering means 72 as shown in FIG. 2. The wash liquid continues through opening 64 past the disc valve and through the filtering means 72 outwardly through the outlet opening 76.

As the agitator 26 reverses its motion and begins rotating in a clockwise direction, as shown by arrow CW, the liquid begins to flow in a reverse direction relative to the agitator which results in the liquid flowing downwardly through the chamber 70 and through opening 64. However, the disc valve 68 quickly closes the opening 64, as shown in FIG. 5, and prevents the liquid from flowing downwardly through the interior of the barrel and causes the liquid in the agitator to gain clockwise inertia or momentum due to the clockwise movement of the agitator.

The clockwise inertia of the wash liquid in the spiral channel 44 is utilized during the next portion of the oscillatory cycle of the agitator when the agitator again is rotated in the counterclockwise direction. It is the clockwise inertia of the liquid which helps to provide an adequate pumping head to the top of the agitator. This feature is particularly enhanced by the fact that the length of the spiral channel 44 is greater than the circumference of the agitator thereby providing a large volume of water to establish a substantial momentum. Thus, the agitator pumps whenever it rotates in a counterclockwise direction, and retards the movement of water whenever it rotates in the clockwise direction. The floating disc valve means automatically responds to the change in oscillatory direction to control the flow of liquid within the agitator.

Figure 6:
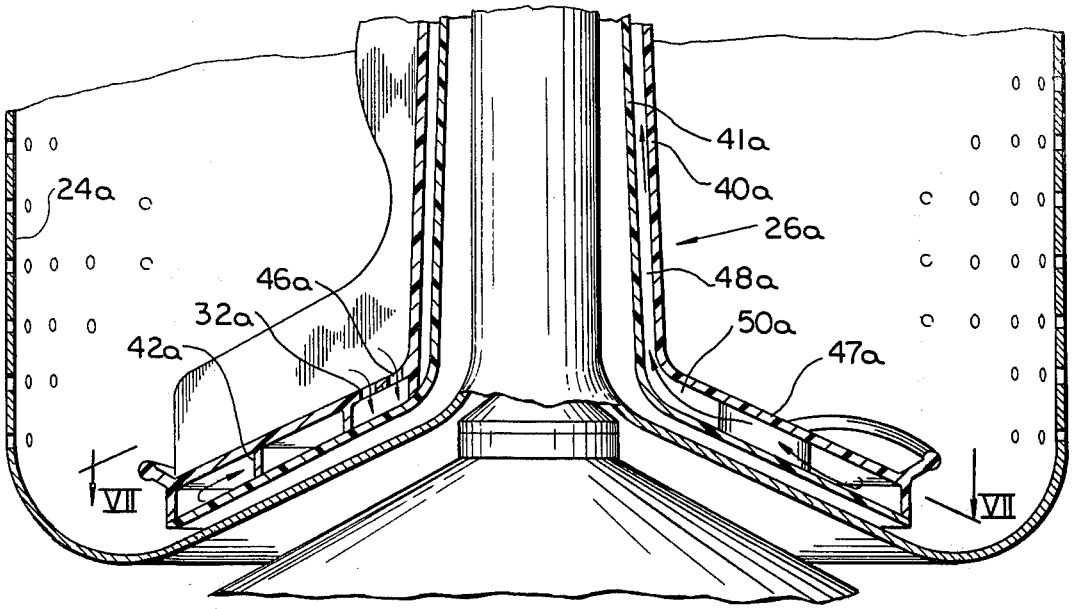
FIG. 6 is a partial sectional view of an alternative embodiment of the agitator assembly within the tub and basket of the washing machine.
Figure 7:
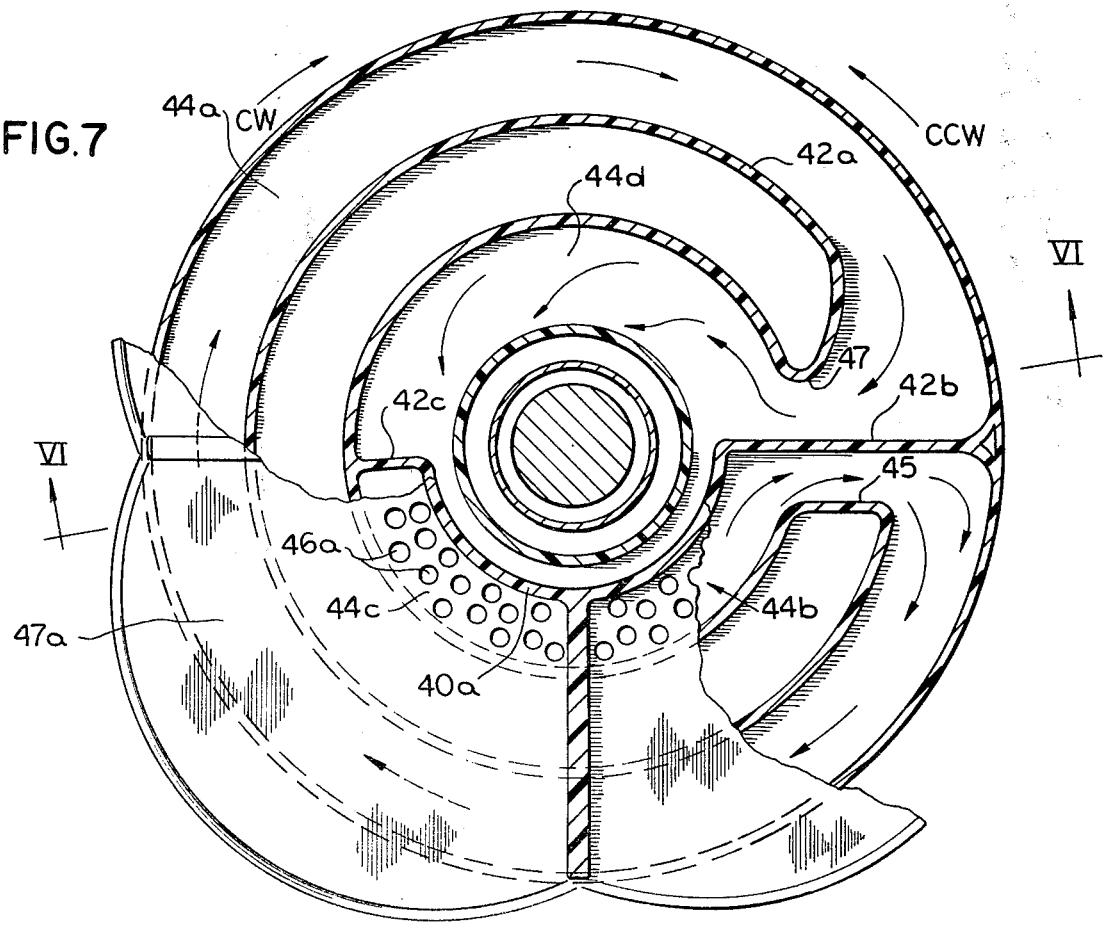
FIG. 7 is a sectional view of the alternative embodiment of the agitator taken generally along the lines VII—VII of FIG. 6.

In FIGS. 6 and 7 there is shown an alternative embodiment of the present invention in which a rib **42*a* is disposed to define an arcuate serpentine channel having a first outer annular channel portion 44*a* and a second inner annular portion 44*b*. The rib 42*a* has a radially outwardly extending portion 42*b* which prevents communication around the entire circumference of annular channels 44*a* and 44*b*. However, channel 44*a* has a length substantially equal to the circumference of the skirt. Additionally, there is a short radial section 42*c* of the rib 42*a* which provides a second barrier in the inner annular channel 44*b* and which is opposite the first radial rib portion 42*b* to divide the inner annular channel 44*b* into essentially two semi-annular channel portions being 44*c* and 44*d*. Inlet openings 46*a* are provided in the top wall 47*a* of the agitator skirt 32*a* adjacent the base of the barrel 34*a* which provides communication between the basket 24*a* and the semi-annular channel 44*c***.

The rib 42a is arranged to provide communication between semi-annular channel 44c and annular channel 44a as shown at 45. Additionally, rib 42a is arranged to provide communication between annular channel 44a and semi-annular channel 44d as is shown at 47. Semi-annular channel 44d communicates at 50a with the annular vertical channel 48a between the outer wall 40a and inner wall 41a of the agitator 26a.

Thus, there is provided a fluid flow path from the interior of the basket 24a through openings 46a in the skirt into semi-annular channel 44c, through opening 45 into annular channel 44a, through opening 47 through into semi-annular channel 44d and into vertical channel 48a.

Periodically throughout the steps of the washing operation, the agitator 26a is rotated in an oscillatory manner such that part of its rotation is in a clockwise direction as shown in FIG. 7 by arrow CW and another part of its rotation is in a counterclockwise direction as shown by arrow CCW. During this movement there is a supply of wash liquid within the basket 24a which is generally above the level of the skirt portion 32a of the agitator 26a such that the wash liquid enters the inlet openings 46a and completely fills the entire serpentine spiral channel portions 44a and 44b. As the agitator 26a oscillates, it acts as a pump in the following manner.

As the agitator rotates in a counterclockwise direction, as shown by arrow CCW, the inertia of the large mass of wash liquid within the channel portion 44a tends to result in a relative rotational movement between the liquid and the agitator. In this manner, the liquid in the channel portion 44a moves toward channel portion 44d, inwardly toward the opening 50a and upwardly through the annular space or vertical channel 48a lifting the free floating disc valve as described above. The wash liquid flows through the filtering means outwardly through the outlet openings as previously described.

As the agitator 26a reverses its motion and begins rotating in a clockwise direction, as shown by arrow CW, the liquid begins to flow in a reverse direction relative to the agitator which results in the liquid flowing downwardly through the chamber and the opening adjacent the disc valve. However, the disc valve quickly closes the opening and prevents the liquid from flowing downwardly through the interior of the barrel and causes the liquid in the agitator to gain clockwise inertia or momentum due to the clockwise movement of the agitator.

The clockwise inertia of the wash liquid in the outer channel portion 44a is utilized during the next portion of the oscillatory cycle of the agitator when the agitator is again rotated in the counterclockwise direction. It is the clockwise inertia of the liquid which helps to provide an adequate pumping head to the top of the agitator. This feature is particularly enhanced by the fact that the length of the outer channel portion 44a is approximately equal to the circumference of the agitator and is at the periphery of the skirt which has the greatest rotational velocity thereby providing a large volume of water with substantial momentum.

Thus, the agitator 26a pumps whenever it rotates in a counterclockwise direction, and retards the movement of water whenever it rotates in the clockwise direction. The floating disc valve means automatically responds to the change in oscillatory direction to control the flow of liquid within the agitator.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a vertical axis automatic washer having a basket for containing clothes to be washed in a washing liquid, a drive means for providing an oscillatory motion to a vertical agitator shaft extending within said basket and a liquid pumping agitator mounted for oscillatory movement with said shaft, said liquid pumping agitator comprising:

a vertical barrel drivenly connected to said shaft, said barrel defining an outlet fluidly connected to said basket and an interior fluid passage extending upwardly from a lower end of said barrel to said barrel outlet;

a skirt integrally connected to said lower end of said barrel, said skirt defining an interior arcuate passage fluidly connected at an inlet to said basket and at an outlet to said barrel passage; and a flow responsive valve means in said barrel interior passage for retarding the downward flow of wash liquid from said barrel passage through said skirt passage, whereby washing liquid is pumped by the oscillatory motion of said agitator from said skirt inlet to said barrel outlet.

2. The apparatus of claim 1, wherein said interior passage in said barrel contains a chamber portion in which can be removably mounted a washing liquid treatment member.

3. The apparatus of claim 1, wherein said annular passage has an inlet comprised of openings through a top wall of said skirt.

4. The apparatus of claim 1, wherein said outlet in said barrel is positioned adjacent the top of the barrel.

5. The apparatus of claim 1, wherein said vertical barrel has a removable top cap portion which provides access to the interior of said barrel.

6. The apparatus of claim 1, wherein said interior arcuate passage in said skirt has a length greater than the circumference of said skirt.

7. The apparatus of claim 1, wherein said interior arcuate passage comprises a spiral having a continually decreasing radius between said skirt inlet to said skirt outlet.

8. The apparatus of claim 7, wherein said skirt inlet fluidly connected with said basket is comprised of openings through a top wall of said skirt adjacent the periphery thereof.

9. The apparatus of claim 1, wherein said interior arcuate channel is of a serpentine shape having an outer portion substantially equal in length to the perimeter of said skirt.

10. The apparatus of claim 9, wherein said outer portion of said serpentine channel is positioned at the periphery of said skirt.

11. The apparatus of claim 9, wherein said skirt inlet is comprised of openings through a top wall of said skirt adjacent said barrel.

12. A washing machine agitator comprising:

a vertical barrel defining a fluid outlet and an interior passage extending upwardly from a lower end of said barrel to said barrel outlet;

a skirt integrally connected to said lower end of said barrel, said skirt defining an interior spiral passage with an inlet through said skirt and an outlet to said barrel passage; and a flow responsive valve means in said barrel interior passage for retarding the flow of washing liquid downward from said barrel passage through said skirt passage.

13. For use in an automatic washer, an agitator means comprising:

a vertical barrel adapted to be driven in an oscillatory manner, said barrel defining an outlet and an interior passage extending upwardly from a lower end of said barrel to said barrel outlet;

a skirt integrally connected to said lower end of said barrel, said skirt defining an interior arcuate passage with an opening through said skirt and an outlet to said barrel passage, said skirt outlet spaced at least approximately 360° along said skirt passage from said skirt inlet; and a flow responsive valve means in said barrel interior passage for retarding the downward flow of washing liquid from said barrel passage to said skirt passage, whereby the oscillatory motion of said agitator in said automatic washer operates to pump washing liquid from said skirt inlet to said barrel outlet.

14. In a vertical axis automatic washer of the type having a basket for containing clothes to be washed in the washing liquid, a vertical agitator shaft extending within said basket;

a liquid pumping agitator mounted for oscillatory movement with said shaft and having a vertical barrel drivenly connected to said shaft;

said barrel defining an outlet fluidly connected to said basket and an interior passage extending upwardly from a lower end of said barrel to said barrel outlet;

means at said lower end of said barrel for forming a spiral passage fluidly connected at an inlet to said basket and an outlet to said barrel passage; and a flow responsive valve means in said barrel interior passage for retarding the downward flow of wash liquid from said barrel passage to said spiral passage, whereby washing liquid is pumped by the oscillatory motion of said agitator from said inlet to said barrel outlet.

15. A washing machine agitator comprising:

a vertical barrel portion defining an outlet and an interior passage extending upwardly from a lower end of said barrel to said barrel outlet, a passage forming means at said lower end of said barrel portion for defining an interior arcuate passage with an inlet and an outlet; and a free floating disc valve means in said barrel interior passage for retarding the downward flow of washing liquid from said barrel passage through said arcuate passage.

16. For use in an automatic washer, an agitator means adapted to be driven in an oscillatory manner, said agitator means defining an outlet and an interior passage extending upwardly from a lower end to said agitator outlet;

wall means forming a generally horizontally disposed spiral fluid passage having a first end and a second end, said wall means further defining an inlet aperture at said first end and an outlet aperture to said interior passage at said second end; and a flow responsive valve means in said interior passage for retarding the downward flow of washing liquid from said interior passage through said spiral passage, whereby the oscillatory motion of said agitator in said automatic washer operates to pump washing liquid from said inlet aperture to said agitator outlet.

17. In a vertical axis automatic washer having a basket for containing clothes to be washed in a washing liquid, a drive means for providing an oscillatory motion to a vertical agitator shaft extending within said basket and a liquid pumping agitator mounted for oscillatory movement with said shaft, said liquid pumping agitator comprising:

a vertical barrel drivenly connected to said shaft, said barrel defining an outlet fluidly connected to said basket and an interior fluid passage extending upwardly from a lower end of said barrel to said barrel outlet;

a skirt integrally connected to said lower end of said barrel, said skirt defining an interior arcuate passage fluidly connected at an inlet to said basket and at an outlet to said barrel passage; and a valve means in said barrel interior passage for retarding the flow of wash liquid from said barrel passage through said skirt passage, wherein said valve means is comprised of a free floating disc in said interior passage, whereby washing liquid is pumped by the oscillatory motion of said agitator from said skirt inlet to said barrel outlet.

* * * * *